United States Patent [19]

Huber

[11] 4,273,287

[45] Jun. 16, 1981

[54] ATOMIZER HEAD FOR PAINT SPRAY GUNS

[75] Inventor: Willi Huber, Altstätten, Switzerland

[73] Assignee: J. Wagner AG, Fed. Rep. of Germany

[21] Appl. No.: 68,220

[22] Filed: Aug. 20, 1979

[30] Foreign Application Priority Data

Sep. 22, 1978 [DE] Fed. Rep. of Germany ..... 2841384

[51] Int. Cl.[3] ..... B05B 7/08

[52] U.S. Cl. ..... 239/299; 239/290

[58] Field of Search ..... 239/290–301, 239/424.5

[56] References Cited

U.S. PATENT DOCUMENTS

| | | | |
|---|---|---|---|
| 3,907,202 | 9/1975 | Binoche | 239/424.5 |
| 4,004,733 | 1/1977 | Law | 239/290 X |
| 4,055,300 | 10/1977 | Binoche | 239/296 X |

*Primary Examiner*—Robert W. Saifer

*Attorney, Agent, or Firm*—Hill, Van Santen, Steadman, Chiara & Simpson

[57] ABSTRACT

An atomizer head for use with a spray gun has a centrally located paint spray orifice with an essentially elliptical cross-section and a pair of compressed air output orifices offset from the paint spray orifice. The output air forms a screen, with an elliptical cross-section, that prevents the paint spray from breaking up.

7 Claims, 2 Drawing Figures

ATOMIZER HEAD FOR PAINT SPRAY GUNS

BACKGROUND OF THE INVENTION

1. Field of the Invention

The invention pertains to the field of paint spray atomizers.

2. The Prior Art

Two basic kinds of atomizer heads are known for paint spray guns. In air type spraying, the paint is fed to the exit nozzle almost without pressure and the atomizing as well as the transport to the workpiece is brought about by compressed air. In airless spraying, the paint is brought to the nozzle under a high pressure of, for example, 200 bar, so that the paint atomizes by itself when exiting from the nozzle. The paint reaches the workpiece without needing additional compressed air as a result of its kinetic energy. Recently, a third kind of atomizer head has become known. This is a combined air-airless spray head. The paint is maintained under high pressure but not as high pressure as in the case of purely airless paint sprayers. Compressed air is additionally used in lesser quantities of flow than in the case of purely compressed air paint sprayers.

In the combined method, pressures between 30 and 100 bar are used and the additional compressed air serves both to provide the atomization and to transport the paint to the workpiece. An atomizer head of this sort is taught by the German OS No. 2,422,597. One disadvantage of this known atomizer head is its complexity. Separate compressed air borings and orifices are necessary to produce atomization and to transport the paint to the article. A second disadvantage lies in the performance of the known atomizer head. At the edges of a fan-type paint spray, paint particles break away from the spray and are not directed to the workpiece.

There is thus a need for a simple, combined air-airless spray head, with improved paint deposition where fan-type sprays are being used.

SUMMARY OF THE INVENTION

The inventive combines air-airless atomizer has a body with a centrally located boring wherein paint is transported to a spray orifice. The orifice, centrally located, has an elliptical cross-section.

On each side of the paint spray orifice are compressed air orifices. Both compressed air orifices are fed from a single compressed air boring. Each compressed air orifice has a cross-section corresponding in shape to a section of a circle.

Each compressed air orifice has a length somewhat longer than the length of the paint spray orifice. The compressed air orifices are shaped so that an air flow having an elliptical cross-section is set up. This air flow fully encloses the paint spray. The two air sprays intersect at their edges, due to the length of the air orifices, thus minimizing the break away of paint drops from the edge of the fan-shaped spray.

In addition to assisting in the atomization of the spray, the air screen produces a very high degree of paint deposition on the article being painted.

DETAILED DESCRIPTION OF THE PREFERRED EMBODIMENT

Figure 1:
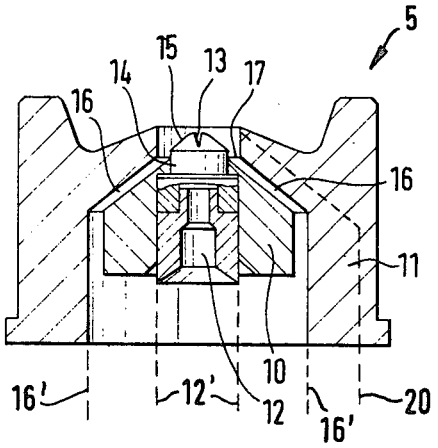
FIG. 1 is a schematic representation of the atomizer head in longitudinal section.
Figure 2:
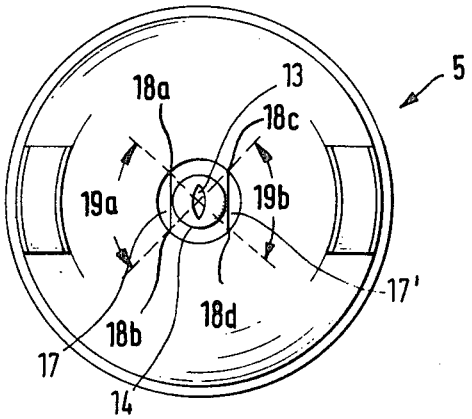
FIG. 2 is a schematic representation of an end view onto the atomizer head of FIG. 1.

Not by way of limitation but by way of disclosing the best mode and by way of enabling one of ordinary skill to practise my invention there is shown in FIGS. 1 and 2 one embodiment of my invention.

An atomizer head 5 has a nozzle body 10 and an air cap 11 which surrounds the body 10 concentrically. The nozzle body 10 possesses an interior boring 12, which is connected to a paint feed conduit 12' shown in phantom. The boring 12 terminates at a slot-shaped nozzle opening 13. The nozzle or orifice 13 has an essentially elliptical cross-section. Orifices such as the orifice 13 produce a fan-shaped spray pattern and are, in general, designated as fan spray nozzles. The orifice 13 is supported by a cylindrical body portion 14 which terminates at a conical surface 15. Surface 15 tapers to the nozzle opening 13. The air cap 11 includes two groove-like recesses which are covered by the nozzle body 10 and thus form air channels 16. The air channels 16 are connected to a compressed air feed 16' shown in phantom. The channels 16 terminate in a circular segment-like air exit opening 17. The air orifices 17 are adjacent the cylindrical surface 14 and on opposite sides thereof.

As can be seen from FIG. 1, the air exit openings 17 are arranged opposite the nozzle body 10 and are directed towards the cylindrical part 14 of the nozzle body 10. Opposite the surface of the cylinder part 14, the orifices 17, or respectively, the feed channels 16 are oriented at an angle of approximately 45° with respect to an axis of rotation of the body member 10.

As shown in FIG. 2, the orifices 17 are elongated with ends 18*a–d*. The orifices 17 extend parallel to the major axis of the nozzle slot 13 and finally, which is of particular importance, the orifices 17 have a length which exceeds the diameter of the cylinder 14 such that the end sections 18*a, b* and 18*c, d*, respectively, of the orifices 17, 17' are located opposite one another directly without the cylindrical surface 14 in between. Expressed differently, the arc length 19*a, b* of each of the air orifices 17 should lie between 30° and 80° when measured with respect to the center of the housing 11.

The atomizer head 5 functions in the following way. In operation, when affixed to a spray gun, paint is fed to the nozzle 13 via the boring 12, and paint supply conduit 12'. The paint is under a pressure of between 30 and 100 bar. The paint then exits from the nozzle orifice 13 in the form of a fan spray, which consists of atomized paint particles. At the same time, via the channels and air conduit 16', 16, compressed air under pressure of, for example 2 bar, is fed to the two segment openings 17. The compressed air which is exiting from the middle region of the air orifices 17 strikes the cylindrical surface 14 and is deflected toward the front surface 15 whereby it then assists in atomization of the paint. Additionally, the compressed air surrounds the two fan sides of the paint fan spray in a screening manner. The compressed air exiting at the outer ends 18*a, b*, of the orifice 17 is directed toward compressed air exiting at outer edges 18*c, d*. The air streams from the end points 18*a, b* intersect the streams from end points 18*c, d*, thereby providing a closed air screen having an essentially elliptical cross-section with the paint fan-spray centrally located therein. In other words, the paint fan-spray is completely surrounded by a screening air spray having an oblong elliptical cross-section. As a result, individual paint drops are inhibited from breaking away from the spray. Besides this, the atomization is improved and additionally, kinetic energy is imparted to the spray to convey it to the article.

Of course, the atomizer head 5 is also suited for electrostatic paint spraying, in which case, the atomizer head 5 itself is designed with an electrode 20 shown in phantom in FIG. 1. All standard electrode arrangements can be used with the spray head 5. The atomizer head can have various embodiments. The two air feed channels 16 could be brought together into a connected ring channel formed by an interior plane of the air cap 11 and an outer surface of the nozzle body 10. Also, the cross-sectional form of the air exit openings 17 need not necessarily be circular segment-shaped. Nevertheless, it is essential that orifices 17 be of such a length that the compressed air streams which flow out of the end regions 18*a–d* intersect one another such that the air shield surrounding the paint fan-spray is closed at the edges.

Although various modifications might be suggested by those skilled in the art, it should be understood that I wish to embody within the scope of the patent warranted hereon all such modifications as reasonably and properly come within the scope of my contribution to the art.

I claim as my invention:

1. An improved paint spray nozzle having an outer housing, a centrally located cylindrical member having an upper conical surface on which is located a paint spray orifice having an essentially elliptical cross-section, operable to form a fan-shaped paint spray, a paint input port flow connected to the spray orifice, and a compressed air input port, the improvement comprising:

a first and a second compressed air output orifice flow connected to the compressed air input port;

said two orifices having a selected shape and being disposed, in spaced apart relationship on opposite sides of the cylindrical member supporting the spray orifice and located a selected distance upstream of an outer edge of the upper conical surface, at a selected acute angle with respect to a longitudinal axis of the cylindrical member;

said two air output orifices cooperating with the cylindrical member and the upper conical surface to form a screen of air, having essentially an elliptically shaped cross-section fully enclosing the fan-shaped spray.

2. The improved nozzle according to claim 1 wherein:

each of said air output orifices has a first elongated straight edge joined at a first and a second end by an arc of a circle having a selected radius and with each said straight edge of each said air output orifice being located adjacent the cylindrical member and parallel to a major axis of the elliptical paint spray orifice.

3. The improved nozzle according to claim 2 with:

each said straight edge of each said air output nozzle having a length a selected amount greater than the major axis of the elliptical paint spray orifice.

4. The improved nozzle according to claim 1 wherein:

said acute angle is substantially a forty-five degree angle.

5. An improved paint spray nozzle having an outer housing, a centrally located cylindrical member having an upper conical surface on which is located a paint spray orifice having an essentially elliptical cross-section, operable to form a fan-shaped paint spray, a paint input port flow connected to the spray orifice, and a compressed air input port, the improvement comprising:

a means affixed to the nozzle, for forming an air screen, fully surrounding the fan-shaped paint spray, said air screen having an essentially elliptical cross-section, said means including:

a first and a second compressed air output orifice having a selected shape and size, located in spaced relationship to the paint spray orifice, and at a selected angle with respect to a longitudinal axis of the cylindrical member;

each said orifice has a straight edge joined by a circular edge and oriented with each said straight edge being essentially parallel to a major axis of the elliptical paint spray orifice.

6. The improved orifice according to claim 5 wherein:

each said straight edge of each said orifice is located essentially adjacent the cylindrical member, a selected distance from the major axis of the paint spray orifice.

7. The improved nozzle according to claim 5 with each said straight edge having a length a selected amount greater than the major axis of the paint spray orifice.

* * * * *

UNITED STATES PATENT AND TRADEMARK OFFICE

CERTIFICATE OF CORRECTION

PATENT NO. : 4,273,287

DATED : June 16, 1981

INVENTOR(S) : Willi Huber

It is certified that error appears in the above—identified patent and that said Letters Patent is hereby corrected as shown below:

On the front page of the Patent, Item No. [73], change

"Assignee: J. Wagner AG, Fed. Rep. of Germany" to
--Assignee: J. Wagner AG, Altstätten, Switzerland--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*